US006032947A

United States Patent [19]

Parker

[11] Patent Number: 6,032,947

[45] Date of Patent: Mar. 7, 2000

[54] APPARATUS AND METHODS FOR STACKING FORMS AND MOVING THE STACKED FORMS SELECTIVELY IN ONE OF TWO DIRECTIONS

[75] Inventor: Rebecca L. Parker, Grand Island, N.Y.

[73] Assignee: Moore U.S.A. Inc., Grand Island, N.Y.

[21] Appl. No.: 08/988,273

[22] Filed: Dec. 10, 1997

[51] Int. Cl.[7] ..... B65H 31/04

[52] U.S. Cl. ..... 271/213; 271/220; 271/223; 209/583; 414/789.9; 414/790.7

[58] Field of Search ..... 271/213, 220, 271/223, 224, 184, 298, 302, 225; 414/788.9, 790.7, 789.9; 209/583

[56] References Cited

U.S. PATENT DOCUMENTS

| | | | |
|---|---|---|---|
| 2,485,952 | 10/1949 | Apgar et al. . | |
| 2,506,550 | 5/1950 | Morrison . | |
| 2,606,669 | 8/1952 | Morrison . | |
| 2,693,885 | 11/1954 | Junco . | |
| 3,079,150 | 2/1963 | Lopez . | |
| 3,208,603 | 9/1965 | Kinker . | |
| 3,382,966 | 5/1968 | Califano et al. . | |
| 3,463,485 | 8/1969 | Atwood . | |
| 3,525,444 | 8/1970 | Brockmüller . | |
| 3,912,258 | 10/1975 | Martin . | |
| 4,034,846 | 7/1977 | Burgis et al. . | |
| 5,398,919 | 3/1995 | Suter . | |
| 5,478,064 | 12/1995 | Kalisiak . | |
| 5,746,568 | 5/1998 | Ogawa et al. | 414/790.7 X |

FOREIGN PATENT DOCUMENTS

| | | |
|---|---|---|
| 0448732 | 10/1991 | European Pat. Off. . |
| 3707845 | 9/1988 | Germany . |

*Primary Examiner*—David H. Bollinger
*Attorney, Agent, or Firm*—Nixon & Vanderhye P.C.

[57] ABSTRACT

A bi-directional stacking conveyor is mounted below the discharge from a main conveyor and lies substantially perpendicular to the main conveyor. An adjustable length backstop and adjustable width guide fingers are carried by the stacking conveyor to accommodate forms of different lengths and widths, the backstop and side guides holding the sheets snugly in the stack. In response to a signal from a controller, the guide fingers on a side of the stack in the direction of desired movement are displaced to an out-of-the-way position and a motor drives the stacking conveyor belt to displace the stack in a first direction. At the end of a job or completion of a count and responsive to a signal to move the stacked sheets in an opposite direction, the controller operates the stepper motor for the opposite fingers to displace those fingers out of the path of movement of the stacked sheets in the opposite direction so that the motor is reversed and the conveyor belts displace the stacked sheets in the opposite direction.

10 Claims, 5 Drawing Sheets

APPARATUS AND METHODS FOR STACKING FORMS AND MOVING THE STACKED FORMS SELECTIVELY IN ONE OF TWO DIRECTIONS

TECHNICAL FIELD

The present invention relates to apparatus and methods for stacking forms and selectively displacing the stacked forms in either of two directions and particularly relates to apparatus and methods for stacking forms and diverting the stacked forms for movement selectively in one of two opposite directions while providing only one main diverting structure and having minimum delay between the end of the stack formation and the beginning of a second stack formation.

BACKGROUND

In the production of certain types of business forms, the forms must be stacked up to a certain height. Only those stacks of forms up to a specified height can proceed to the next piece of equipment. Those between that specified height and a higher or maximum height must be diverted in a different direction to other equipment. Present stacking equipment cannot perform that function and has a longer than desirable eject cycle time which pauses preceding or upstream equipment, slowing production of the forms. Consequently, there has been a need to reduce the eject cycle time of a forms stacker, while eliminating the need for a separate diverting device after the stacking device in order to displace the stacked forms in the appropriate direction for further downstream processing.

DISCLOSURE OF THE INVENTION

According to the present invention, a bi-directional stacking conveyor is mounted below the discharge from a main conveyor and lies substantially perpendicular to the main conveyor. The stacking conveyor has an adjustable length backstop to accommodate forms of different lengths. The forms exit the main conveyor over a fixed height drop-off located just above the desired maximum stacked height, the forms hitting the backstop and settling into a stack on the stacking conveyor. The stacking conveyor also includes side guides for positively engaging both sides of the forms or sheets being stacked to snugly hold the sheets in the stack. The side guides are adjustable in width relative to one another to accommodate sheets of different widths. The stacking conveyor is driven in opposite directions by a reversible motor under the control of a controller.

It is a significant feature of the present invention that the side guides are not only adjustable in width to accommodate different widths of the forms or sheets, but are movable between positions serving as guides for and straddling the side edges of the sheets being stacked and positions out of the path of movement of the stack of forms or sheets when the forms stack is moved by the stacking conveyor in one of the opposite directions. More particularly, each side guide includes a plurality of fingers mounted on a rotatable shaft below the conveying surface of the stacking conveyor. Each shaft is driven by a stepper motor. To accommodate different widths of the sheets, the shafts and stepper motors are movable along the stacking conveyor frame toward and away from one another into selected adjusted positions. When it is desired to move the stacked sheets from the stacking location on the stacking conveyor in a first direction, the fingers on that side are pivoted by the stepper motor to a position out of the path of movement of the stacked forms, enabling the stacking conveyor to move the stacked forms in that first direction past the displaced fingers. A sensor detects the movement of the stacked forms to one side or the other and the stepper motors are responsive to the detected movement of the stacked forms to rotate the fingers back into their original guide positions for receiving sheets forming the next stack of sheets.

In operation, the stacking conveyor outfeed direction is set to default in one of the two opposite directions. When the stack of forms reaches the end of a job where the stack height is less than or equal to a predetermined specified height, the control system causes the stepper motor to pivot the guide fingers from their guide positions to the out-of-the-way position such that the stacking conveyor may move the stacked forms past the displaced fingers. After the stacked form has been moved, the stacked forms movement sensor signals the control system to return the guide fingers to their upright guide position. Should the height of the stacked forms become greater than the predetermined specified height, the height sensor signals the control system to set the outfeed direction of the stacking conveyor opposite to the first direction. Additionally, the controller operates the stepper motor for the fingers on the opposite side of the stacked forms to displace the fingers to the out-of-the-way position, enabling the stacking conveyor to displace the stacked forms in the opposite direction past the displaced guide fingers. Again, a stacked forms movement sensor senses the movement of the stacked forms and signals the control system to return the guide fingers to their upright guide position.

The direction of movement of the stacked forms may also be responsive to a sensor or bar code reader in the main conveyor to determine the destination of the stacked forms. Thus, upon flow of the stacked forms from the main conveyor onto the stacking conveyor, the sensor detects the bar code indicative of the direction of outfeed and signals the controller to operate the stacking conveyor motor in the desired direction and the appropriate stepper motor to displace the guide fingers to the out-of-the-way position, enabling the stacked forms to move in the indicated direction.

In a preferred embodiment according to the present invention, there is provided apparatus for stacking and conveying stacked sheets in selected opposite directions, comprising a conveyor for sequentially receiving sheets and forming a stack of sheets at a sheet-stacking location along the conveyor, a drive connected to the conveyor for conveying the stacked sheets on the conveyor in selected opposite first and second directions, first and second guides along the conveyor on respective opposite sides of the sheets at the sheet-stacking location for engaging the sides of the sheets to form the stack thereof on the conveyor, the first guide being mounted for movement between a first position engaging the sides of the sheets forming the stack thereof at the sheet-stacking location and a second position out of the path of movement of the stack of sheets in the first direction, enabling the stack of sheets for displacement by the conveyor in the first direction, the second guide being mounted for movement between a first position engaging opposite sides of the sheets forming the stack thereof at the sheet-stacking location and a second position out of the path of movement of the stack of sheets in the second direction, enabling the stack of sheets for displacement by the conveyor in the second direction and a controller for controlling the movement of the first and second guides and the drive connected to the conveyor to enable movement of the stacked sheets selectively in the first and second directions.

In a further preferred embodiment according to the present invention, there is provided a method for stacking sheets and conveying stacked sheets in opposite directions, comprising the steps of conveying sheets consecutively along a first conveyor for stacking on a second conveyor movable bi-directionally and generally perpendicular to the first conveyor, providing guides for guiding the sheets along opposite side edges thereof as the sheets are stacked on the second conveyor, selectively displacing the guides from a position guiding the sheets to a position out of the path of movement of the stacked sheets in a selected one of the opposite directions and conveying the sheets along the second conveyor in the selected one of the opposite directions.

In a still further preferred embodiment according to the present invention, there is provided a method for stacking sheets and conveying stacked sheets in opposite directions, comprising the steps of conveying sheets along a first conveyor in a first direction, stacking the sheets received from the first conveyor on a second conveyor movable in opposite directions generally perpendicular to the first conveyor, engaging opposite sides of the sheets being stacked by using at least one guide on each side of stacked sheets located in a position blocking movement of the stacked sheets on the conveyor in opposite directions and displacing a guide along one side of the stacked sheets from the position blocking movement of the stacked sheets on the second conveyor in one of the opposite directions to a non-blocking position to enable the second conveyor to move the stacked sheets in the one opposite direction.

Accordingly, it is a primary object of the present invention to provide apparatus and methods for stacking forms on a bi-directional stacking conveyor and moving the stacked forms in one of two directions with minimum delay, with reduced eject cycle time and without need for a separate diverting device after the forms stacking device.

BEST MODE FOR CARRYING OUT THE INVENTION

Figure 1:
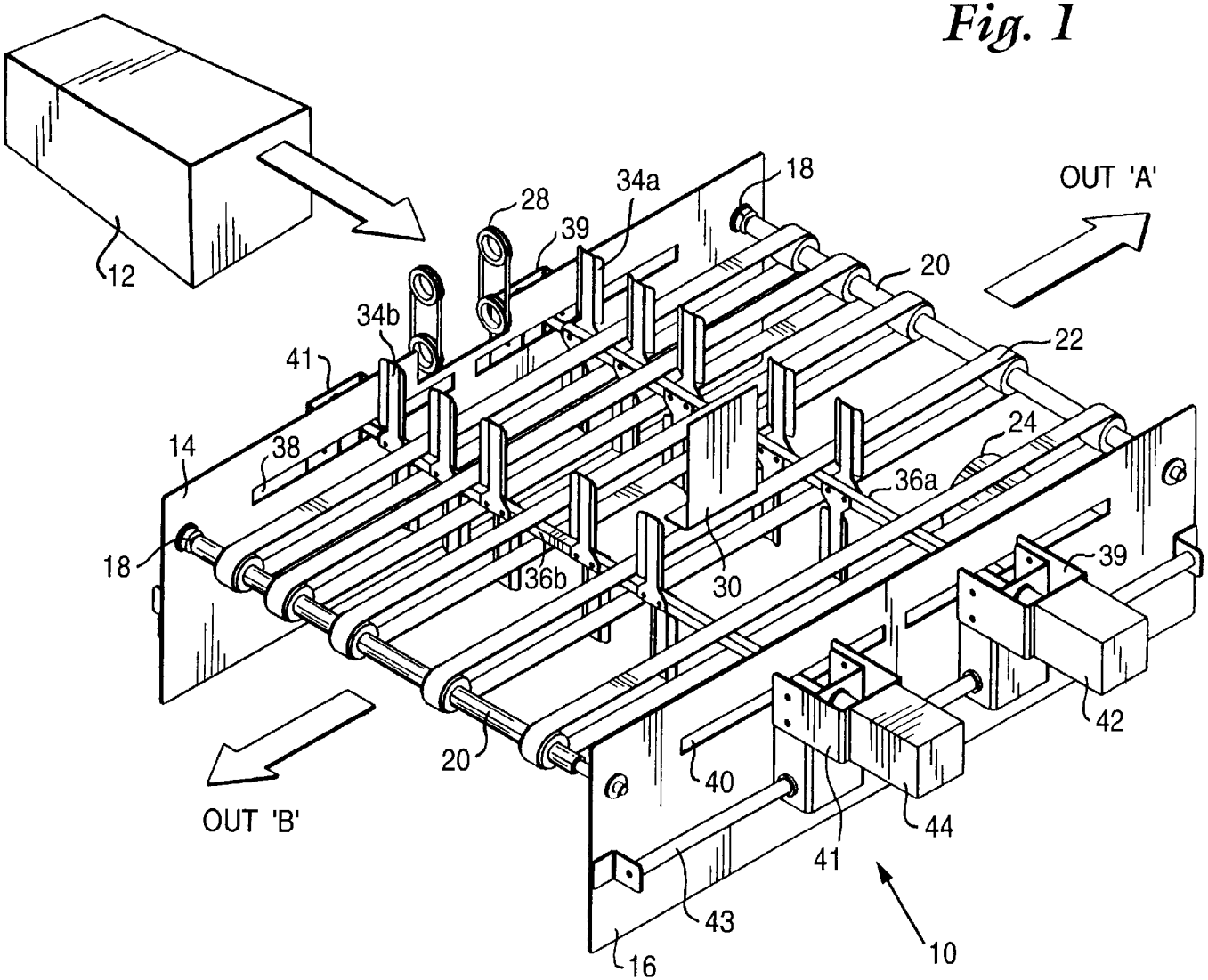
FIG. 1 is a schematic perspective view of a stacking conveyor constructed in accordance with the present invention.
Figure 2:
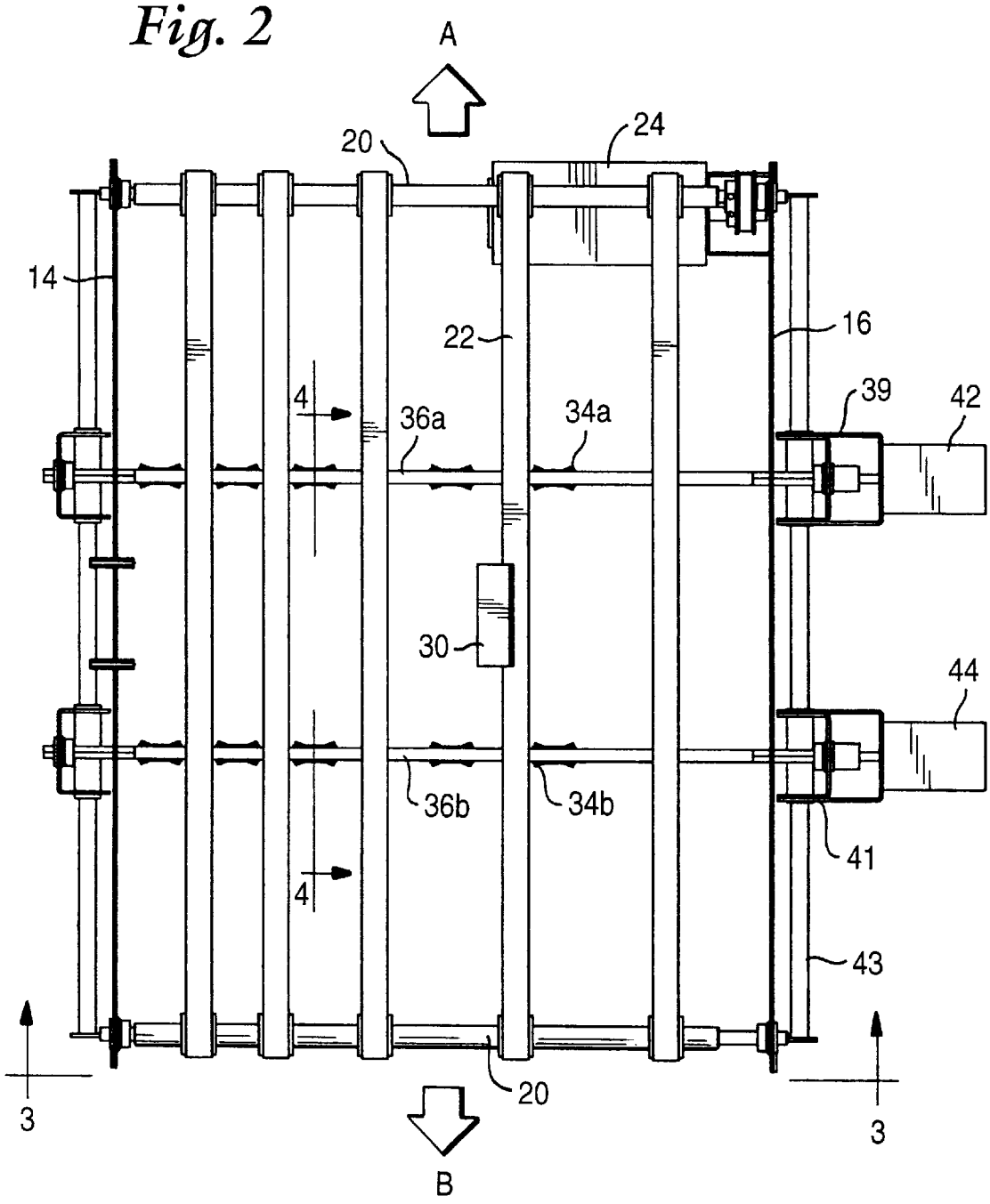
FIG. 2 is a top plan view thereof.
Figure 3:
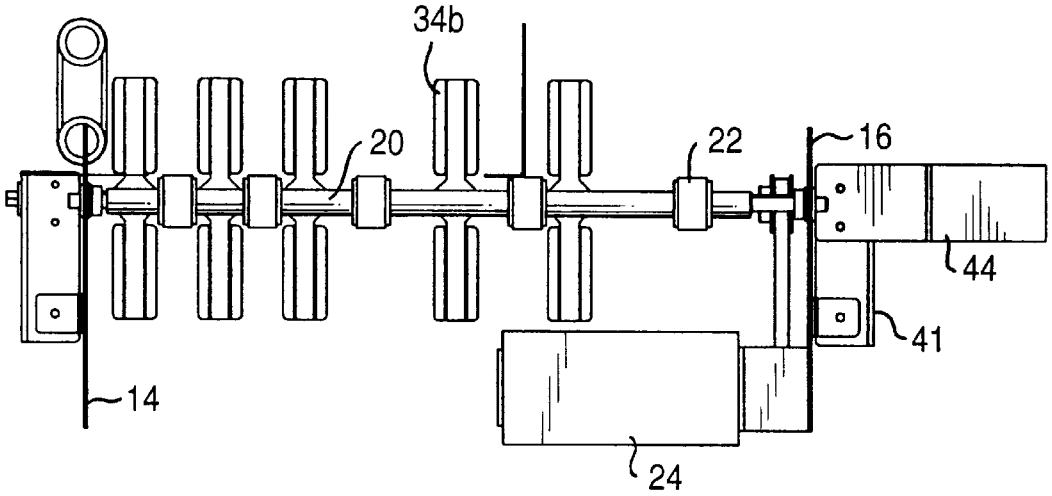
FIG. 3 is an end view thereof taken generally about on line 3—3 in FIG. 2.
Figure 4:
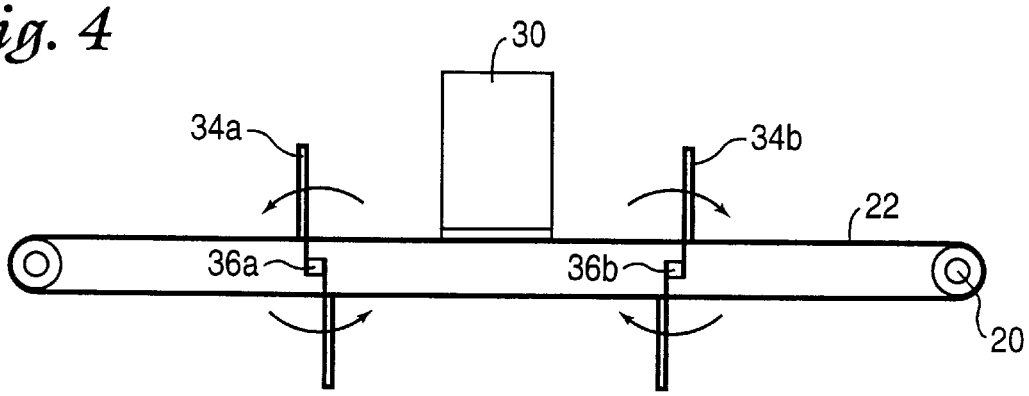
FIG. 4 is a schematic cross-sectional view thereof taken generally about on line 4—4 in FIG. 2.

Referring to FIGS. 1 and 2, there is illustrated a stacking conveyor, generally designated 10, for receiving business forms or sheets from an input device, schematically illustrated at 12. The input device may comprise a main conveyor for conveying business forms or sheets one at a time onto the stacking conveyor 10 in stacked relation. The stacking conveyor includes a frame having a pair of side plates 14 and 16 between which are mounted in suitable bearings 18 a pair of shafts 20. In the illustrated preferred form, the stacking conveyor comprises a plurality of endless belts 22 spaced transversely one from the other about rollers on the shafts 20. A reversible motor 24 is also mounted on the frame and is coupled to at least one of the shafts 20 for rotating the shaft and hence displacing the upper conveying surfaces of the belts in one of two opposite directions, indicated by outfeed directions A and B. The motor 24 may be any type of motor capable of reversing while running. For example, the motor may be a permanent magnet DC; brushless DC; shunt wound DC; or permanent split capacitor AC. Other motors, of course, will come to mind to those skilled in the art.

Figure 5:
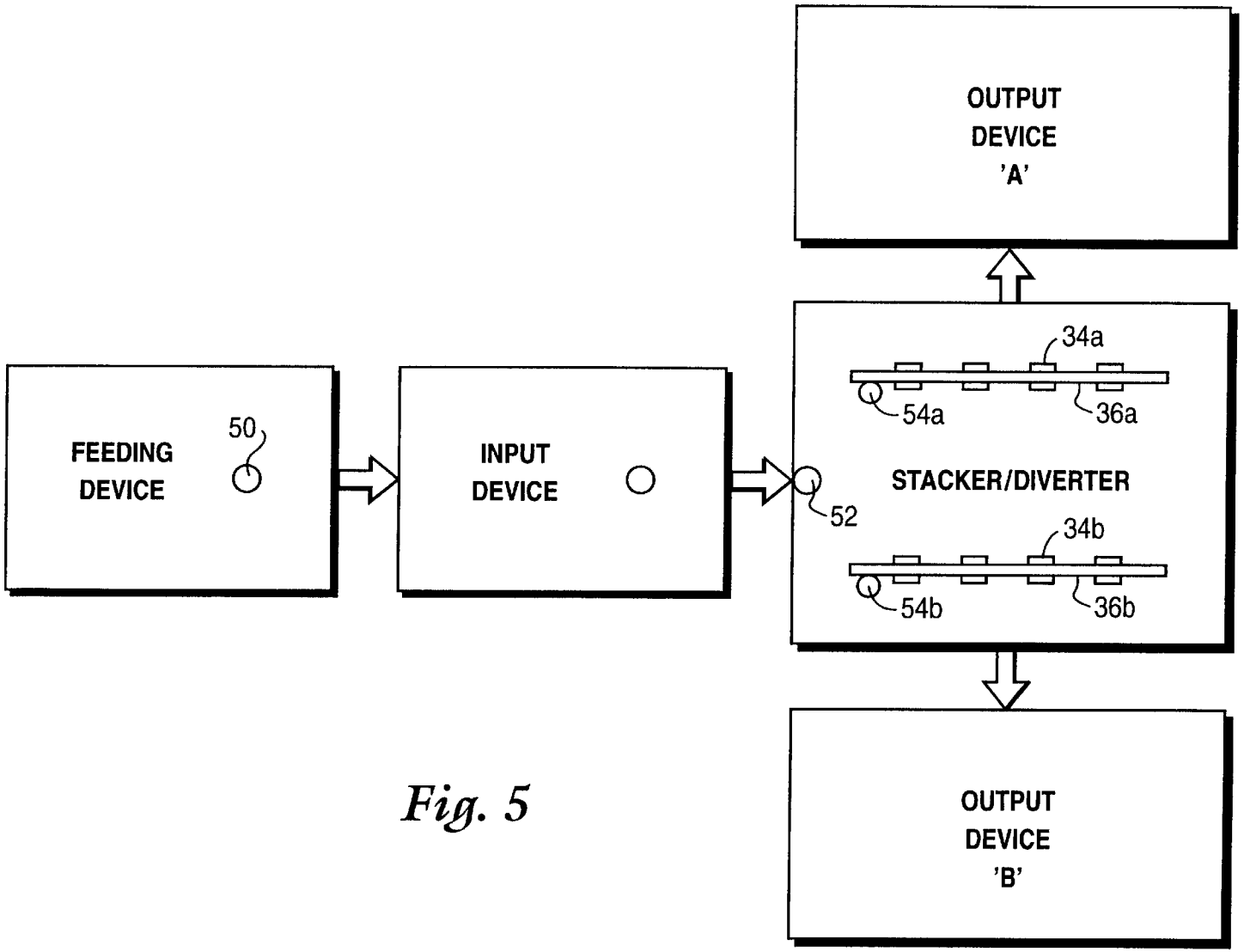
FIG. 5 is a schematic block diagram of a control for the forms stacker and diverter of the present invention.

Disposed adjacent the output of the input device 12 is a drop-off device 28, the upper end of which is above the conveying surface of conveyor 10 a height at least equal to the maximum height of the stack of forms being fed onto conveyor 10. From a review of drawing FIGS. 1 and 5, it will be appreciated that the forms or sheets are input to conveyor 10 generally at right angles thereto. A backstop 30 is carried by the stacking conveyor 10 and forms a stop for the leading edges of the sheets fed from the input device 12 onto the stacking conveyor 10. The backstop 30 is adjustable in position toward and away from the drop-off device 28 to accommodate forms of different lengths. The manner of slidably mounting the backstop 30 in adjusted positions relative to the device 28 may comprise one of any number of different ways. For example, the backstop may be mounted in slides below the conveyor for movement toward and away from the device 28. The belts 22 may also be displaced toward and away by displacement of the rollers on shafts 20 to accommodate the movement of the backstop.

Guides are also provided for engaging the opposite sides of the sheets being stacked onto conveyor 10 to snugly hold the sheets in the stack. These guides are also adjustable toward and away from one another to accommodate different widths of the forms. More particularly, the guides on each side of the stacking location on conveyor 10 comprise one and preferably a plurality of fingers 34*a* and 34*b* mounted on shafts 36*a* and 36*b*. During stacking, the fingers 34*a* and 34*b* extend in a vertically upright position as illustrated in FIG. 1 and serve to position the sheets in alignment in the stack as the sheets engage against the backstop 30 and settle into the stack.

To accommodate different widths of the sheets being stacked, the shafts 36*a* and 36*b* are slidable in slots 38 and 40 formed in the side frames 14 and 16, the slots extending in the direction of conveyance of conveyor 10. It will be appreciated that by moving the shafts 36*a* and 36*b* toward and away from one another, the width between the upstanding fingers 34*a* and 34*b* is adjustable. To accomplish this, the opposite ends of the shafts 36*a* and 36*b* are rotatably mounted in suitable bearings carried by brackets 39 and 41, respectively. The brackets 39 and 41 in turn are mounted for sliding movement along guide shafts 43 carried along outside surfaces of the side frames 14 and 16. Thus, by displacing the brackets 39 and 41 along the guide shafts 43 and locking the brackets in a predetermined position, for example, by using set screws, the distance between the fingers 34*a* and 34*b* on opposite sides of the stacking location can be selectively adjusted.

The guide fingers 34*a* and 34*b* are movable out of the path of movement of the stacked sheets in accordance with the direction of movement of the stacked sheets. For example, the fingers 34*a* along the upper portion of the conveyor 10 illustrated in FIG. 1, when the conveyor 10 displaces the stacked material in direction A, are moved out of the path of movement of the stacked material, enabling the stacked material to move in direction A. Similarly, the upstanding fingers 34*b* in the lower part of the conveyor 10 illustrated in FIG. 1 are moved out of the path of movement of the stacked sheets when the conveyor 10 displaces the stacked sheets in direction B. To accomplish this, the shafts 36 mounting the fingers 34*a* and 34*b* are rotatable by stepper motors 42 and 44, respectively. By selectively operating the stepper motors 42 and 44, it will be appreciated that the guide fingers 34*a* and 34*b* associated with the respective shafts 36*a* and 36*b* can be moved between the illustrated upright vertical positions guiding the sheets being stacked on conveyor 10 and out-of-the-way positions generally parallel to the conveying surface of the belts 22, enabling the stacked sheets to be moved by the conveyor 10 in one of the directions A or B.

Figure 6A:
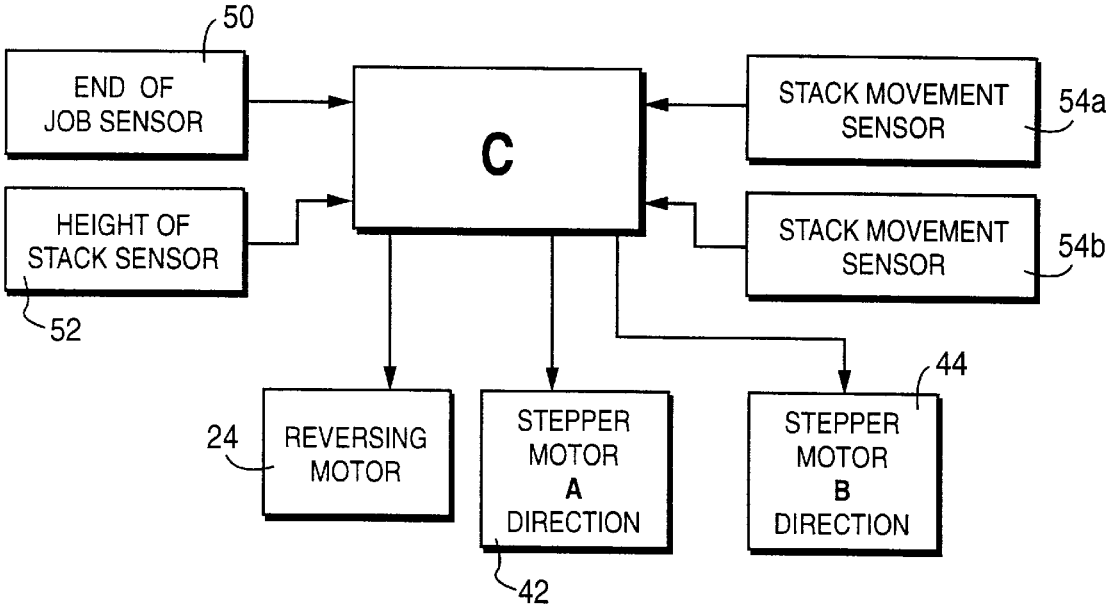
FIGS. 6*a* and 6*b* are block diagrams of control systems for the stacking conveyor hereof.

Different types of control systems may be employed for diverting the stacked sheets in the opposite directions A or B. For example, a controller C (FIG. 6*a*) receives a signal from a sensor 50 which, for example, may read a sensing mark on the last sheet of the stack or first sheet of the next stack or a counter in the feeding device and which signal determines the end of the job for a particular stack. Additionally, a height sensor 52 in the stacking conveyor 10 senses the height of the stack of sheets. The controller C, in response to the end of the job signal, then sets the stacker outfeed direction in accordance with the signal from the height sensor 52. For example, if the height sensor 52 detects a height of the stacked sheet below or at a predetermined specified height, the outfeed direction is maintained by controller C in direction A, e.g., a default direction. The controller C thus drives the reversing motor 24 in the appropriate direction to feed the stack of material in direction A and also operates stepper motor 42 to pivot fingers 34*a* to a position out of the path of movement of the stack of sheets in direction A. When the stack of sheets has moved past the pivoted fingers, a sensor 54*a* signals the controller that the stack has been moved and the controller then operates the stepper motor 42 to pivot the fingers 34*a* into the upright guiding position. The controller may signal the motor 24 to continue moving the conveyor in direction A or to stop the conveyor until a further signal is received.

Should the height of the stack be above a predetermined height, the signal from the height sensor 52 is used by the controller C to set the outfeed direction B. Thus, the controller reverses the direction of movement of the motor 24 and activates stepper 44 to pivot fingers 34*b* to an out-of-the-way position enabling the stacked sheets to move from the stacked location in the direction B. When the stack has moved past the pivotal fingers 34*b*, a sensor 54*b* signals the controller that the stack has been moved and the controller then operates the stepper motor 44 to pivot fingers 34*b* into the upright guiding position. The controller may then revert to the default setting of direction A.

Figure 6B:
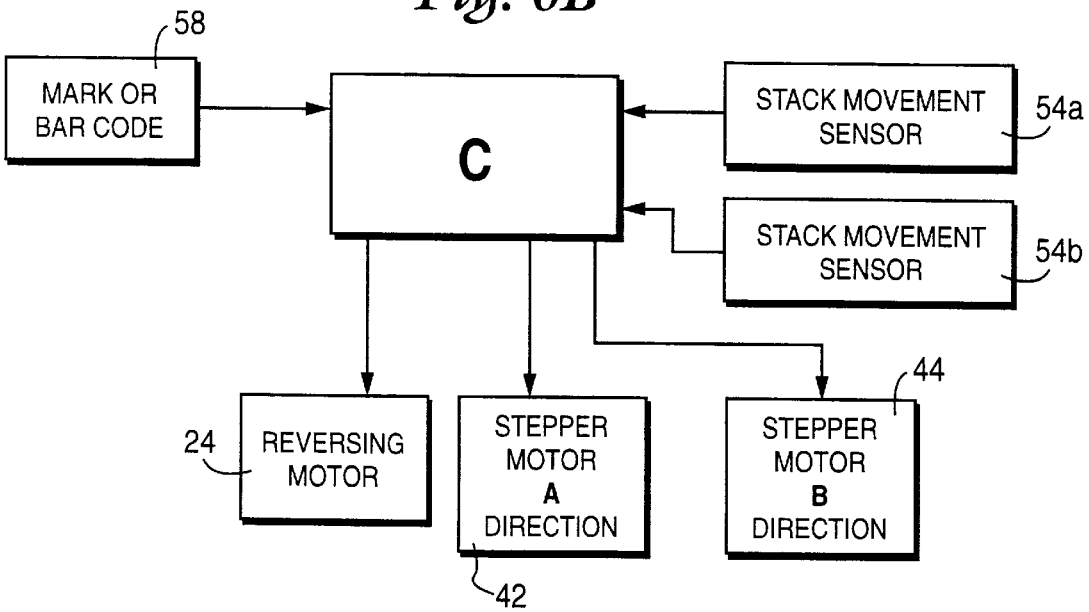

The operation of the machine may also be based on a mark or bar code reader in the feeding device, e.g., sensor 58 (FIG. 6*b*), the input device or on the stacker conveyor to determine the direction of the destination of the stacked sheets. The stacking conveyor outfeed direction is set to a default direction, for example, direction A. When a document set is complete or at the end of a job, the controller operates the reversing motor and stepper motor 42 to displace the stack in the default direction A. If the sensor or bar code indicates the stack should go in direction B, when the job or a predetermined count has been reached, the reversing motor 24 is reversed and stepper 44 is activated to displace fingers 34*b* out of the way of the movement of the stack in direction B. Again, when the stack clears the stack moving sensor 54*b*, the controller operates the stepper motor 44 to displace the fingers 34*b* into their upright vertical position to form guides for the next stack.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. Apparatus for stacking and conveying stacked sheets in selected opposite directions, comprising:

a conveyor for sequentially receiving sheets and forming a stack of sheets at a sheet-stacking location along the conveyor;

a drive connected to said conveyor for conveying the stacked sheets on the conveyor in selected opposite first and second directions;

first and second guides along the conveyor on respective opposite sides of the sheets at the sheet-stacking location for engaging the sides of the sheets to form the stack thereof on the conveyor;

said first guide being mounted for movement between a first position engaging the sides of the sheets forming the stack thereof at said sheet-stacking location and a second position out of the path of movement of the stack of sheets in said first direction, enabling the stack of sheets for displacement by said conveyor in said first direction;

said second guide being mounted for movement between a first position engaging opposite sides of the sheets forming the stack thereof at said sheet-stacking location and a second position out of the path of movement of the stack of sheets in said second direction, enabling the stack of sheets for displacement by said conveyor in said second direction;

a controller for controlling the movement of said first and second guides and the drive connected to said conveyor to enable movement of the stacked sheets selectively in said first and second directions; and each of said guides including a finger pivotally mounted on a shaft below said conveyor for movement between said first position projecting upwardly above said conveyor to engage a side of the stacked sheets and said second position below said conveyor, a frame mounting said fingers for movement into selected adjusted positions along said conveyor to accommodate different widths of sheets being stacked.

2. Apparatus according to claim 1 wherein said drive includes a reversible motor connected to said conveyor for selectively driving the conveyor and stacked sheets thereon in respective opposite directions.

3. Apparatus according to claim 1 including a sheet feeder for supplying sheets onto said conveyor at said stacked sheet location in a direction generally perpendicular to said opposite directions and a stop for limiting movement of said sheets in said perpendicular direction and establishing an end edge for the stacked sheets.

4. Apparatus according to claim 1 including a sheet feeder for supplying sheets onto said conveyor at said stacked sheet location in a direction perpendicular to said opposite directions, a sensor for detecting an end to the formation of the stack of sheets and providing an output signal, a sensor for detecting the height of the stack of sheets at the stacked sheet location providing an output signal, said controller being responsive to said output signals for reversing the direction of said conveyor and operating said guides to enable conveyance of the stacked sheets in said reversed direction.

5. Apparatus according to claim 1 including a sensor for detecting movement of the stacked sheets in one conveyor direction past one of said first or second guides and providing an output signal, said controller being responsive to said output signal for returning said one of said first or second guides from said second position to said first position.

6. Apparatus for stacking and conveying stacked sheets in selected opposite directions, comprising:

a conveyor for sequentially receiving sheets and forming a stack of sheets at a sheet-stacking location along the conveyor;

a drive connected to said conveyor for conveying the stacked sheets on the conveyor in selected opposite first and second directions;

first and second guides along the conveyor on respective opposite sides of the sheets at the sheet-stacking location for engaging the sides of the sheets to form the stack thereof on the conveyor;

said first guide being mounted for movement between a first position engaging the sides of the sheets forming the stack thereof at said sheet-stacking location and a second position out of the path of movement of the stack of sheets in said first direction, enabling the stack of sheets for displacement by said conveyor in said first direction;

said second guide being mounted for movement between a first position engaging opposite sides of the sheets forming the stack thereof at said sheet-stacking location and a second position out of the path of movement of the stack of sheets in said second direction, enabling the stack of sheets for displacement by said conveyor in said second direction;

a controller for controlling the movement of said first and second guides and the drive connected to said conveyor to enable movement of the stacked sheets selectively in said first and second directions; and a sheet feeder for supplying sheets onto said conveyor at said stacked sheet location in a direction generally perpendicular to said opposite directions, a sensor for detecting a mark on the sheets indicative of a desired direction of movement of said conveyor and providing an output signal in response thereto, said controller being responsive to said output signal for reversing the direction of said conveyor and operating said guides to enable conveyance of the stacked sheets in said reversed direction.

7. A method for stacking sheets and conveying stacked sheets in opposite directions, comprising the steps of:

conveying sheets along a first conveyor in a first direction;

stacking the sheets received from said first conveyor on a second conveyor movable in opposite directions generally perpendicular to said first conveyor;

engaging opposite sides of the sheets being stacked by using at least one guide on each side of stacked sheets located in a position blocking movement of the stacked sheets on said conveyor in opposite directions;

displacing a guide along one side of said stacked sheets from the position blocking movement of the stacked sheets on said second conveyor in one of said opposite directions to a non-blocking position to enable said second conveyor to move said stacked sheets in said one opposite direction; and providing a first signal indicative of a predetermined direction of conveyance of the stack along said second conveyor and controlling said guides and the direction of movement of said second conveyor in response to said signal to convey the stack of sheets in said predetermined direction of conveyance.

8. A method according to claim 7 including returning the displaced guide from said non-blocking position to a position engageable with a side of sheets forming a subsequent stack of sheets on said second conveyor.

9. A method according to claim 7 including adjusting the distance between said guides along said second conveyor to accommodate stacking sheets of different widths.

10. A method according to claim 7 including providing a second signal indicative of a completion of a stack of sheets on said second conveyor, providing a third signal indicative of a predetermined height of the stack of sheets on said second conveyor and controlling said guides and the direction of movement of said second conveyor in response to said second and third signals.

* * * * *